US006369494B1

(12) United States Patent
Pruvost et al.

(10) Patent No.: US 6,369,494 B1
(45) Date of Patent: Apr. 9, 2002

(54) CATHODE STRUCTURE AND ELECTRON GUN FOR CATHODE RAY TUBES

(75) Inventors: Jean-Claude Pruvost; Jean Remy Adamski, both of Dijon; Francois Fichet, Chevigny St. Sauveur, all of (FR)

(73) Assignee: Thomson Tubes & Displays, S.A., Boulogne Cedex (FR)

( * ) Notice: Subject to any disclaimer, the term of this patent is extended or adjusted under 35 U.S.C. 154(b) by 0 days.

(21) Appl. No.: 09/402,411

(22) PCT Filed: Apr. 24, 1998

(86) PCT No.: PCT/EP98/02466

§ 371 Date: Oct. 4, 1999

§ 102(e) Date: Oct. 4, 1999

(87) PCT Pub. No.: WO98/49704

PCT Pub. Date: Nov. 5, 1998

(30) Foreign Application Priority Data

Apr. 25, 1997 (FR) ..... 97 05164

(51) Int. Cl.[7] ..... M01J 1/94
(52) U.S. Cl. ..... 313/270; 313/346 R; 313/446
(58) Field of Search ..... 313/346 R, 346 DC, 313/270, 583, 446

(56) References Cited

U.S. PATENT DOCUMENTS

| | | | | |
|---|---|---|---|---|
| 3,333,138 A | 7/1967 | Szegho | ..... | 313/270 |
| 4,990,823 A | 2/1991 | Swaving et al. | ..... | 313/446 |
| 5,289,076 A | 2/1994 | Lee | ..... | 313/37 |

FOREIGN PATENT DOCUMENTS

| | | | | |
|---|---|---|---|---|
| EP | 436360 | 7/1991 | ..... | H01J/1/26 |

*Primary Examiner*—Vip Patel
(74) *Attorney, Agent, or Firm*—Joseph S. Tripoli; Dennis H. Irlbeck; Carlos M. Herrera

(57) ABSTRACT

The invention relates to a cathode structure intended to be inserted into an electron gun for a cathode-ray tube.

The cathode comprises a cathode body on the end of which is placed an emissive pellet, the cathode body being held in place inside a sheath by supporting means which comprise:

a first series of branches, each branch being connected on one side to the cathode body and on the other side to an intermediate piece 30; and a second series of branches, each branch being connected on one side to the sheath and on the other side to the same intermediate piece.

10 Claims, 5 Drawing Sheets

CATHODE STRUCTURE AND ELECTRON GUN FOR CATHODE RAY TUBES

The invention relates to a cathode structure intended to be inserted into an electron gun for a cathode-ray tube.

The current trend is tending towards requiring cathode-ray tubes of increased performance in terms of screen brightness, lifetime, bright-up time and consumption.

Most of these parameters essentially depend on the structure and the type of cathode used to generate the electron beam or beams which will scan the screen of the tube.

The oxide-coated cathodes normally employed hitherto are at their limits with regard to these requirements, and the tendency is to replace them with dispenser cathodes which make it possible to achieve higher current densities with longer lifetimes.

Dispenser cathodes or impregnated cathodes operate at temperatures of about 1000° C.–1200° C. The expansions of the constituent materials of the cathode at these temperatures have to be minimized in order to obtain good performance stability of the electron gun into which this type of cathode is inserted, this being achieved by using a refractory material and dimensions of the cathode support which limit the conductive heat losses.

To achieve this result, Patents U.S. Pat. No. 4,184,100 and U.S. Pat. No. 5,218,263 illustrate two types of structure commonly employed:

- a cathode body of substantially cylindrical shape having, at one end, the emissive part and containing the heating element;
- a metal sheath which serves as shielding, by acting as a heat shield, of substantially cylindrical shape surrounding the cathode body; and
- a means for supporting the cathode body inside the shielding.

The supporting means must be such that they allow rigid assembly while still minimizing the conductive heat losses. The means for supporting the cathode body may be tabs, produced from metal strips, of small cross-section in order to minimize the thermal losses, the ends of these tabs being connected on one side to the cathode body and on the other side to the shielding. In another embodiment, the tabs are cut out from the cylindrical part of the shielding so that one end remains integral with the shielding while the other end is connected to the cathode body.

However, the fact of using metal tabs of very small cross-section does not enable sufficient mechanical rigidity to be achieved, when fitting the cathode body in its sheath and fixing it thereto; moreover, these connection tabs may be easily deformed by the thermal expansion of the cathode body during its operation.

Patent Application EP 534,842 describes a structure in which the supporting means are more rigid, since they consist of a substantially frusto conical ring whose surface is pierced with holes. However, this structure has the drawback of promoting heat exchange between the cathode body and its sheath, thereby impairing the thermal efficiency of the cathode.

An object of the present invention is to improve the cathode support structures in order to allow both rigid assembly of the cathode in its support and minimization of the conductive heat losses between the cathode body and its sheath.

To do this, according to one embodiment of the invention, the cathode structure comprises means for supporting a cathode body inside a metal sheath, wherein the supporting means include a first series of branches connected to the metal sheath via one of their ends and a second series of branches connected to the cathode body via one of their ends, the second ends of the first and second series of branches being connected together by an intermediate piece.

Other advantages will emerge from the description and from the drawings, among which:

FIGS. 1 and 2*a* and 2*b* illustrate means for supporting cathode bodies in their sheath, according to the prior art;

Figure 1:
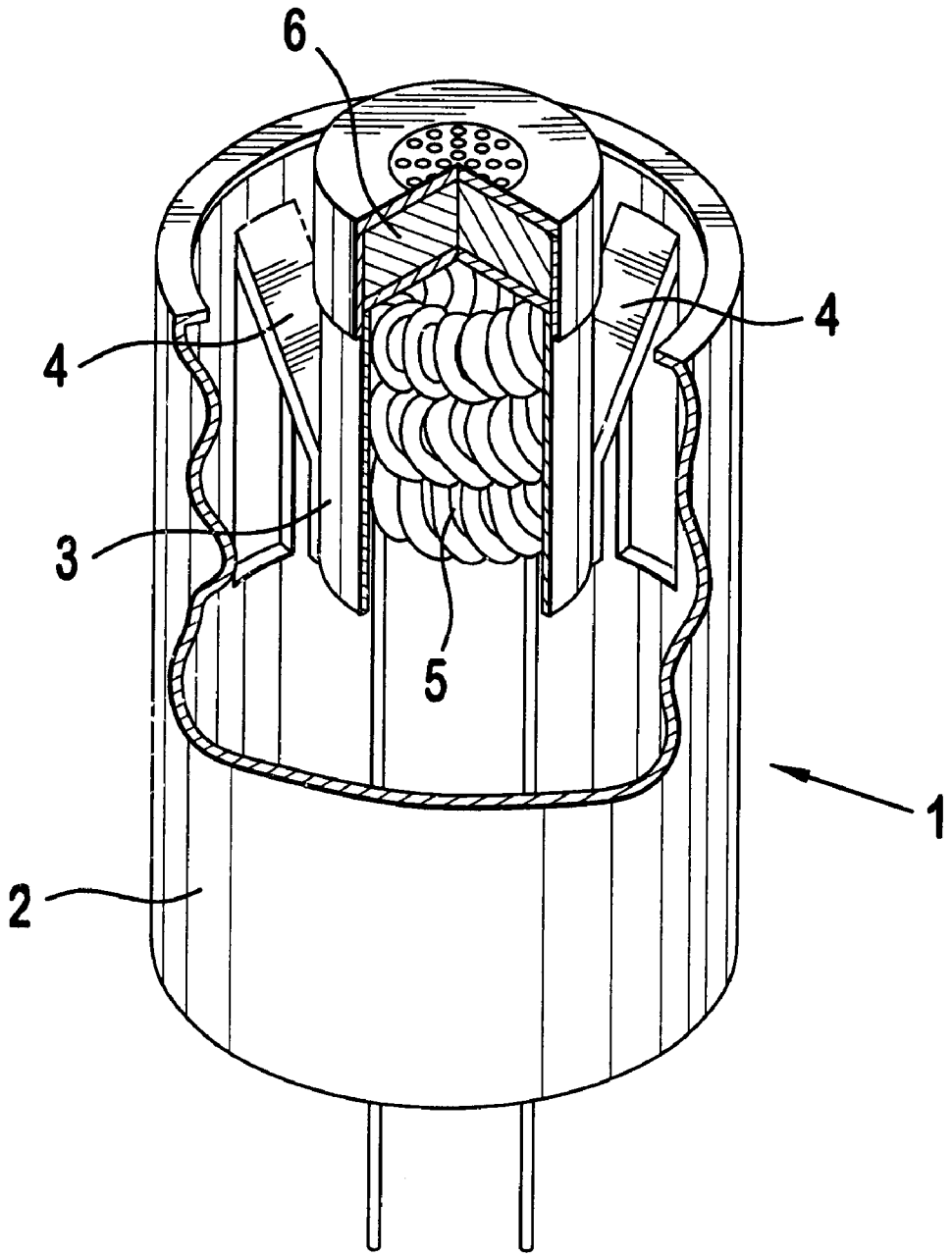
FIG. 1 PRIOR ART

As illustrated in FIG. 1, an impregnated cathode 1 according to the prior art consists of a cylindrical cathode body 3 which comprises an emissive part 6 at one of its ends and, housed in the hollow part of the cathode body, a filament 5 for heating the emissive part. The cathode body is connected to a hollow metal sheath 2 by means of the partial cut-out in the surface of the sheath of tabs 4, one end of which remains integral with the sheath while the other end is pushed towards the inside of the sheath and welded to the cathode body. In order to avoid heat losses from the cathode body to the sheath, it is necessary to use tabs of very small cross-section, something which is difficult to achieve here, the thickness and width of the tabs being limited by the minimum thickness of the sheath (approximately 25–30 $\mu$m), by the access points for spot-welding the ends of the tabs to the cathode body and by the difficulties of cutting out from these materials.

Figure 2A:
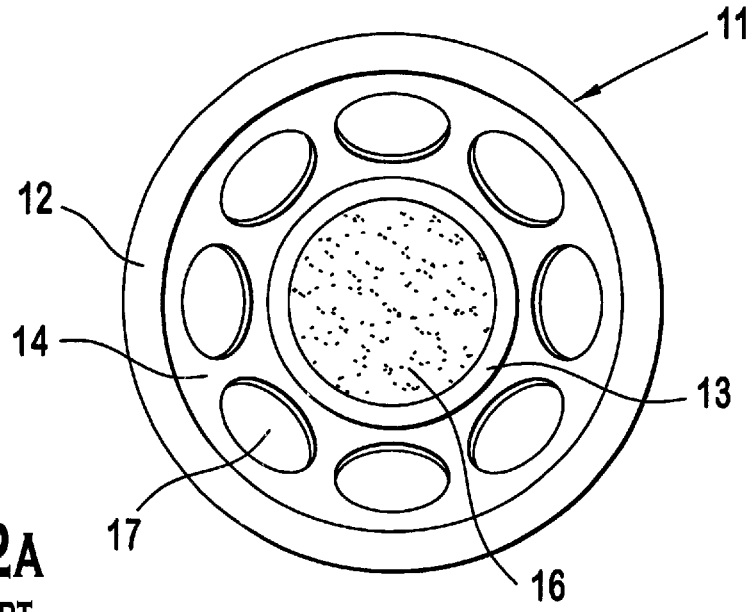
FIG. 2A PRIOR ART
Figure 2B:
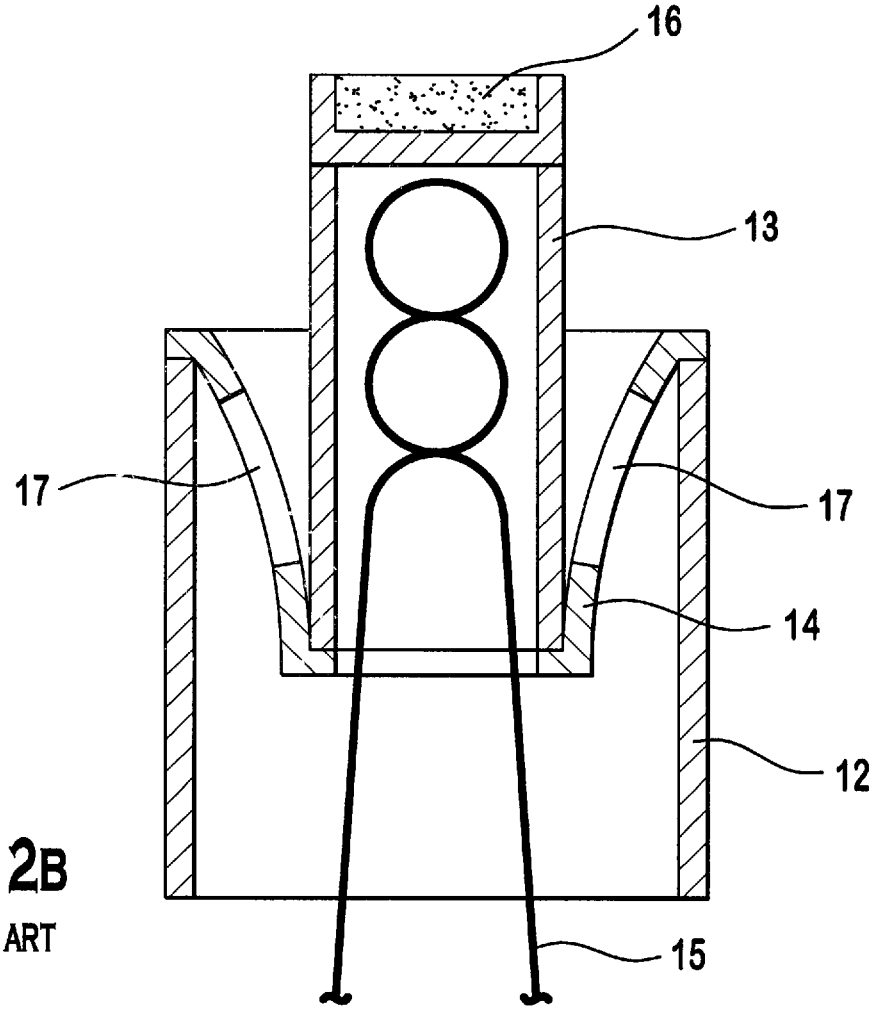
FIG. 2B PRIOR ART

FIGS. 2*a* and 2*b* illustrate another embodiment, seen from above and in cross-section, according to the prior art. The cathode 11 has a cathode body 13 which includes an emissive part 16 and a heating filament 15, the body 13 being inserted into the sheath 12 and connected to the latter via supporting means 14 in the form of a crown of substantially frusto conical shape and drilled with holes 17. These supporting means have the advantage of providing sufficient mechanical rigidity in order to hold the cathode body in place in its sheath, but has the drawback of promoting heat exchange between the body 13 and its sheath 12 because of the large quantity of material forming bridges between the pieces 12 and 13.

Figure 3:
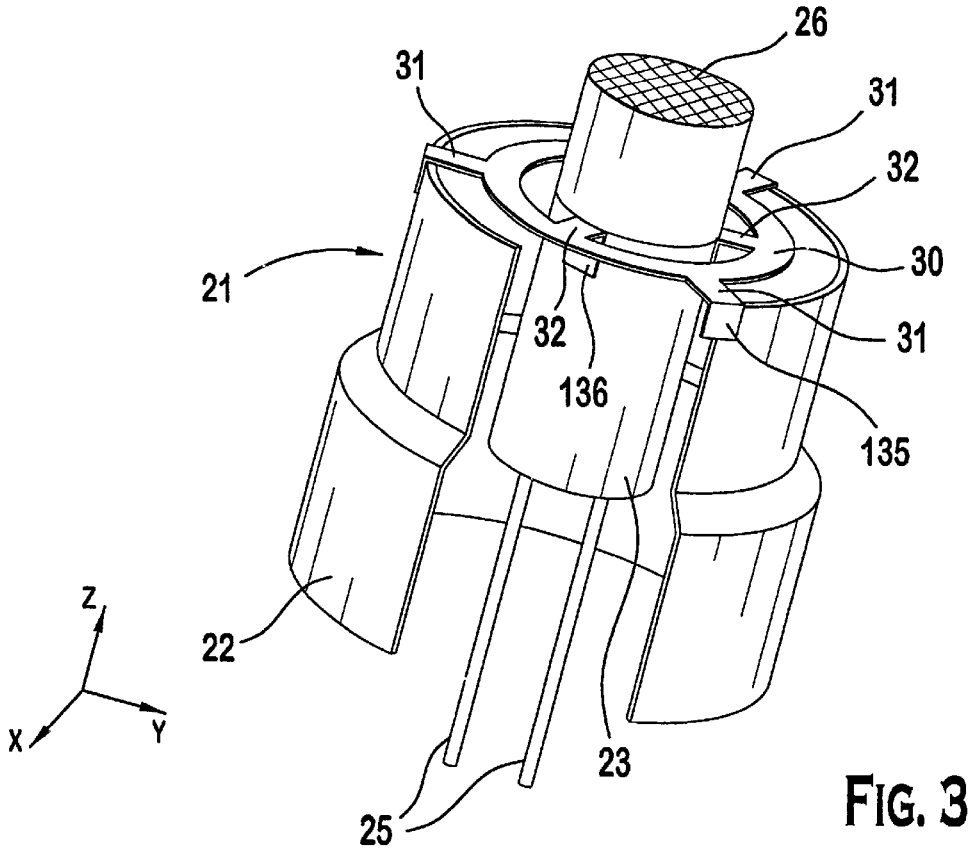
FIG. 3 shows, in an exploded view, a cathode structure in accordance with the invention.

As illustrated in FIG. 3, a cathode 21 in accordance with the invention comprises a cathode body 23 held in position inside the sheath 22, with the aid of the following means:

- a first series of branches 31, each branch being connected, on one side, to the cathode body and, on the other side, to an intermediate piece 30;
- a second series of branches 32, each branch 32 being connected, on one side, to the sheath 22 and, on the other side, to the same intermediate piece 30.

The branches 31 and 32 may be connected by welding to the piece 30 or may form with it a single piece produced, for example, by cutting out from a metal plate, thereby decreasing, in the latter case, the manufacturing cost of the cathode body support.

The intermediate piece 30 is preferably chosen in the form of a ring, the diameter of which has a value intermediate between the internal diameter of the sheath and the external diameter of the cathode body. The mechanical connection between the two series of branches stiffens the cathode support and enables branches of small cross-section to be used, these offering the advantage of low heat dissipation.

Figure 4:
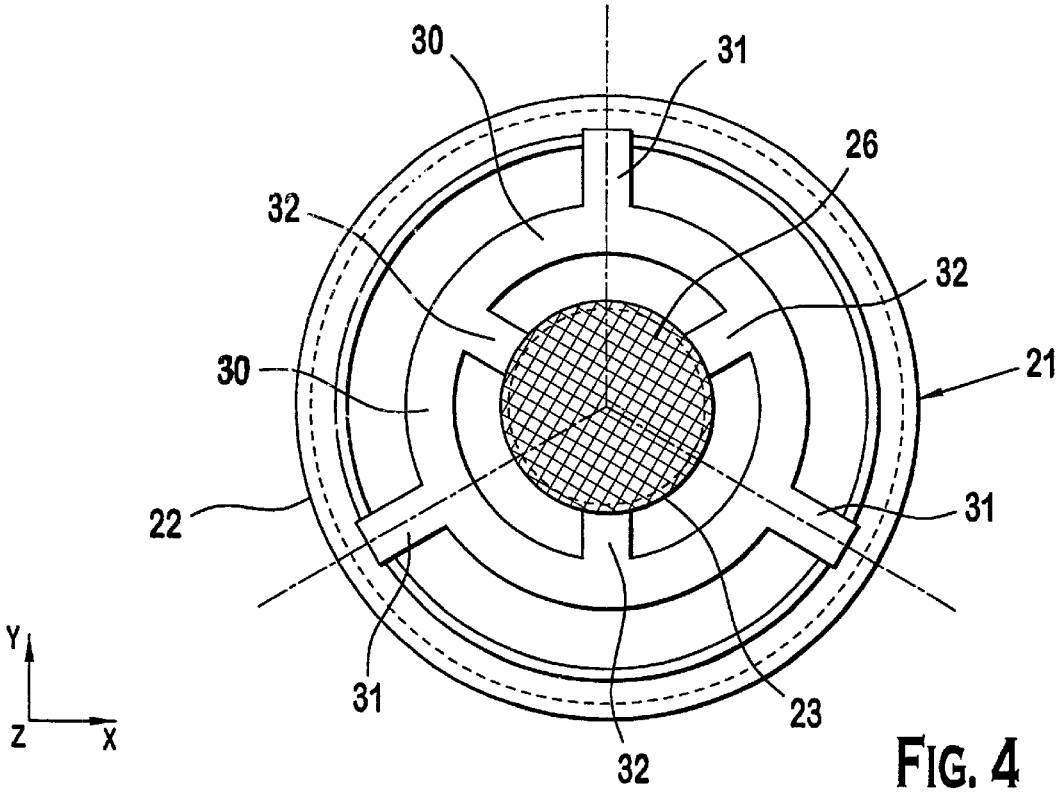
FIG. 4 shows, in a side view from above, a cathode structure according to another embodiment of the invention.

In one embodiment of the invention, as illustrated in FIGS. 3 and 4, the first series of branches 31, one end of which is welded to the sheath 22, comprises three branches arranged at 120° with respect to each other; the second series of branches 32, one end of which is welded to the cathode body supporting the emissive part 26, also comprises three branches arranged at 120° with respect to each other. This structure enables the number of heat bridges between the cathode body and its sheath to be minimized, while at the same time providing good mechanical stability and good positional retention of the cathode body. However, this number is not restrictive, it being possible to use more than three branches in each of the series of branches and/or a different number of branches in the first series of branches from the second.

In a preferred embodiment of the invention, those parts of a series of branches connecting the intermediate piece 30 either to the cathode body or to the sheath 22 lie in the same radial plane perpendicular to the axis Z of revolution of the cathode. The result obtained is that the means for connecting the cathode body to its sheath are shortened and that it is possible to obtain a shorter cathode structure than in the prior art. Those parts of the two series of branches 31 and 32 connecting the intermediate piece 30 to the cathode body and to its sheath may advantageously lie in the same radial plane perpendicular to the axis Z of revolution of the cathode. This structure has the advantage of further shortening the total length of the cathode and of allowing the use of a shorter filament 25 heating the emissive body 26 than in the prior art, resulting in a very rapid bright-up time because of the low thermal mass involved.

Figure 5:
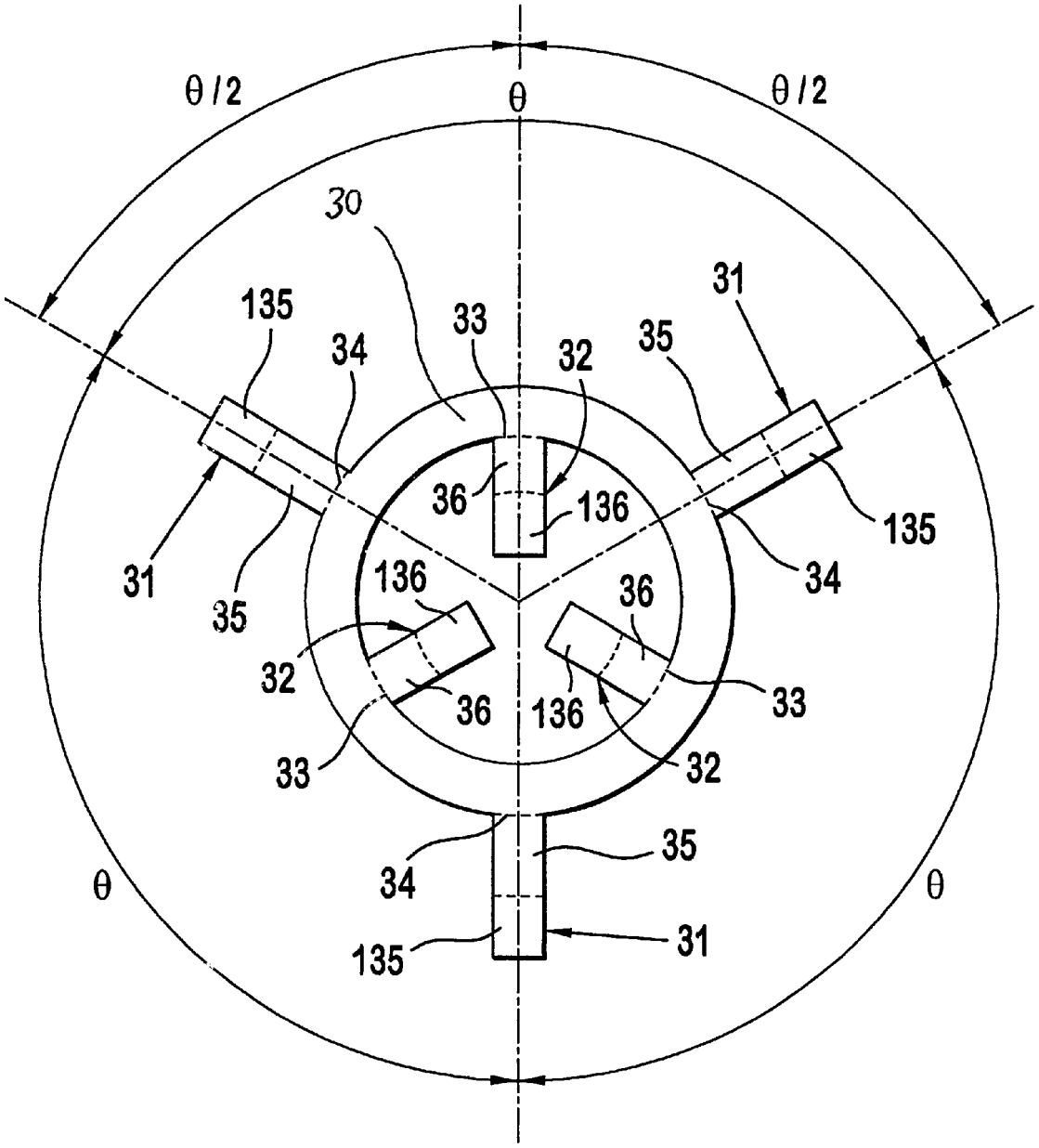
FIG. 5 shows an example of supporting means in accordance with the invention, consisting of a single metal piece.

In another embodiment, the support for the cathode body, illustrated in FIG. 5, comprises a first series of branches 31 extending outwards from the ring starting from junction points 34 and a second series of branches 32 extending inwards from the ring starting from junction points 33, the junction points 33 and 34 being offset so as not to be arranged opposite each other.

The means 30, 31, 32, for supporting a cathode, comprising a cathode body 1.8 mm in diameter and a sheath 4.6 mm in diameter, may be produced by cutting out from a sheet of metal, 25 $\mu$m in thickness, for example nickelchrome in respect of an oxide-coated cathode or tantalum-impregnated cathode. The width of the branches 31, 32 and of the ring 30 is 0.4 mm, and the mean diameter of the ring is 3.2 mm. Each branch 31 includes a first part 35 intended to be placed between the ring 30 and the sheath 22, and an end portion 135 which, once folded so that it is brought parallel to the internal surface of the sheath, will allow the branch to be welded to the sheath. Likewise, each branch 32 includes a first part 36 intended to be placed between the ring 30 and the cathode body 23, and an end portion 136 which, once folded so as to be brought parallel to the external surface of the cathode body, will allow the branch to be welded to the cathode body.

If it is chosen to use N branches 31 offset with respect to each other by an angle $\theta=2\pi/N$, N branches 32 are also used, the junction points 33 of the branches 32 being offset by $\theta/2$ with respect to the junction points 34 of the branches 31. This supporting-means structure has the advantage of increasing the length of the thermal linkage between the cathode body and the sheath, thereby increasing the temperature gradient between the said cathode body and the sheath, of decreasing the conductive heat losses and of shortening the bright-up time of the cathode. Moreover, the offset between the junction points of the internal branches 32 and external branches 31 with the intermediate piece 30 makes it possible to carry out the welding operations more easily, in two steps, firstly the internal branches to the cathode body and then the external branches to the sheath 22. The welding may, in this case, be carried out by laser welding or by electric resistance welding by virtue of the clear space obtained.

Figure 6:
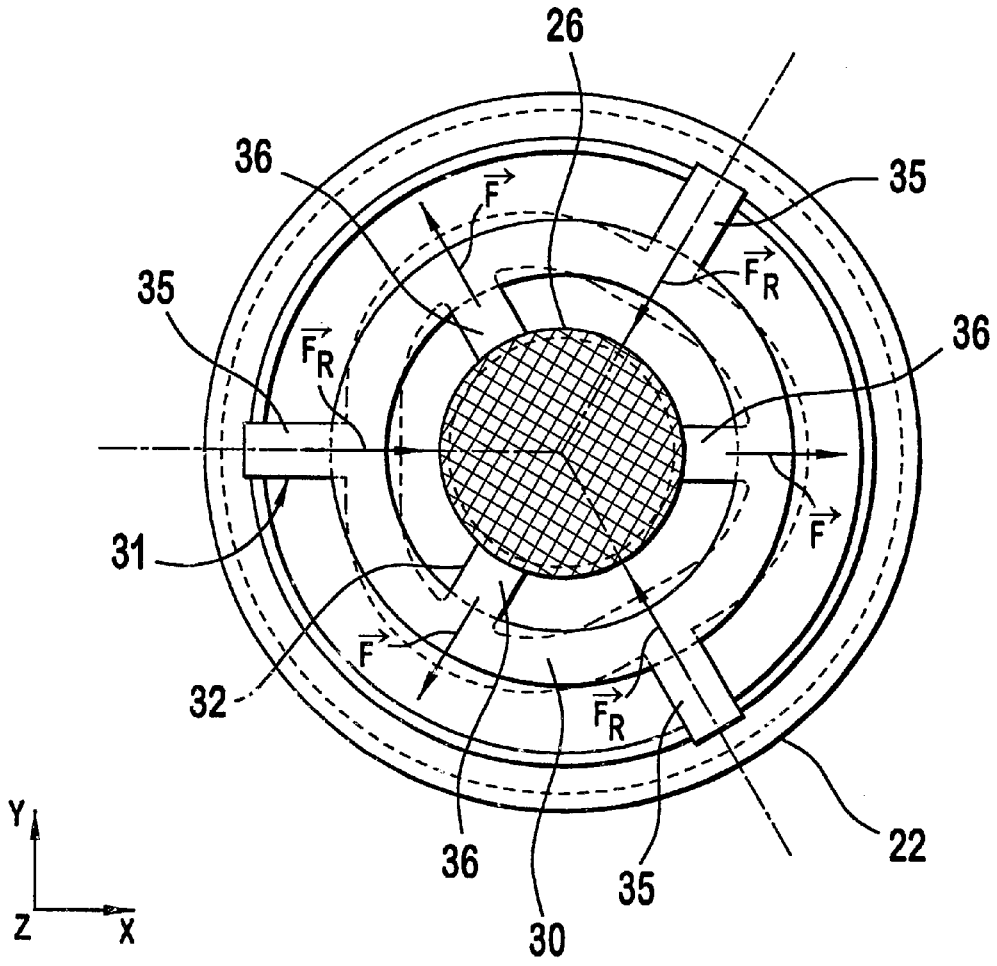
FIG. 6 illustrates the mechanical stresses which the means for supporting the cathode body, according to a first embodiment of the invention, experience when the cathode is brought to temperature.

In another embodiment derived from the previous one, the ring 30 and the parts 35 and 36 of the branches 31 and 32, respectively, lie in the same plane, perpendicular to the axis Z of revolution of the cathode body. This arrangement increases the mechanical stability of the cathode structure; in particular, it prevents movements of the cathode body along the radial axis Z which are due to the elongation of the support branches 31 and 32 by thermal expansion during operation of the cathode. In this case, as indicated in FIG. 6, when the cathode is operated at temperature, the parts 35 and 36 of the branches for supporting the cathode body will be able to lengthen in the radial direction, due to the effect of the temperature, exerting respectively centrifugal forces F and centripetal forces FR on the ring 30, the ring 30 undergoing elastic deformation in the radial plane, under the effect of these forces, as indicated by the dotted lines in FIG. 6. Since the mechanical stresses due to the elongation of the suspension branches are thus absorbed by the ring, the position of the cathode body with respect to its sheath will not vary during the transient cathode-heating period.

As already indicated in respect of the other embodiments of the present invention, the structure described by FIG. 6 is equally applicable to the production of an oxide-coated cathode as to impregnated cathodes.

In an embodiment not shown, the supporting means include an intermediate piece 30 made from a different metal from the branches 31,32, the branches being fastened to the intermediate piece, for example by laser welding. The advantage of this structure is that it allows the metal of the branches 31, 32 to be chosen depending on its abilities to reduce the thermal conduction and enables the metal of the intermediate piece to be chosen depending on its mechanical elasticity properties.

What is claimed is:

1. Cathode structure for a cathode-ray tube, which comprises means for supporting a cathode body inside a metal sheath, the supporting means including a first series of branches connected to the metal sheath via one of their ends and a second series of branches connected to the cathode body via one of their ends wherein the second ends of the first and second series of branches are connected together by an intermediate piece.

2. Cathode structure according to claim 1, wherein the intermediate piece is in the form of a ring.

3. Cathode structure according to claim 1, wherein the branches of at least one series are arranged over part of their length in the same plane.

4. Cathode structure according to claim 2, wherein the intermediate piece is in the form of a flat ring and in that the branches of at least one series are arranged over part of their length in the same plane as the plane of the ring.

5. Cathode structure according to claim 1, wherein the intermediate piece, the first series of branches and the second series of branches form a piece made as a single component.

6. Cathode structure according to claim 1, wherein the first series of branches and/or the second series of branches have at least three branches.

7. Cathode structure according to claim 1, wherein the junction points where the branches of the first series of branches join the intermediate piece are offset with respect to the junction points where the branches of the second series of branches join the intermediate piece.

8. Cathode structure according to claim 7, wherein the first and second series of branches have the same number of branches and in that the junction point where each branch of the same series joins the intermediate piece is arranged half-way between the junction points where the two consecutive branches of the other series join the ring.

9. Electron gun incorporating a cathode whose structure is according to claim 1.

10. Cathode-ray tube incorporating at least one electron gun according to claim 9.

* * * * *